US007500559B2

(12) United States Patent
Kim

(10) Patent No.: US 7,500,559 B2
(45) **Date of Patent: *Mar. 10, 2009**

(54) METHOD AND APPARATUS FOR DISPLAYING CLOTHING AND CLOTHING ACCESSORIES

(75) Inventor: Cin Kim, Alpine, NJ (US)

(73) Assignee: Peacock Apparel Group, Inc., New York, NY (US)

( * ) Notice: Subject to any disclaimer, the term of this patent is extended or adjusted under 35 U.S.C. 154(b) by 300 days.

This patent is subject to a terminal disclaimer.

(21) Appl. No.: 11/337,028

(22) Filed: Jan. 19, 2006

(65) Prior Publication Data

US 2007/0045131 A1 Mar. 1, 2007

Related U.S. Application Data

(63) Continuation-in-part of application No. 11/222,039, filed on Sep. 7, 2005, which is a continuation-in-part of application No. 11/216,268, filed on Aug. 30, 2005.

(51) Int. Cl.
*B65D 85/18* (2006.01)

(52) U.S. Cl. ..... 206/278; 206/292; 206/806; 206/495; 223/87

(58) Field of Classification Search ..... 206/278, 206/288, 746, 806, 6.1, 279, 284, 287.1, 206/289, 292, 297, 294, 495; 223/DIG. 1, 223/85, 87, 88, 98
See application file for complete search history.

(56) References Cited

U.S. PATENT DOCUMENTS

| | | | | | |
|---|---|---|---|---|---|
| 2,626,735 | A * | 1/1953 | Gwinn et al. | 223/87 |
| 3,069,009 | A * | 12/1962 | Hoeflich | 206/284 |
| 3,081,881 | A * | 3/1963 | Seeger | 211/85.3 |
| 3,370,765 | A * | 2/1968 | Jossem | 223/87 |
| 3,592,343 | A * | 7/1971 | Swett et al. | 211/123 |
| 3,783,995 | A * | 1/1974 | Tobin | 206/232 |
| 4,190,151 | A * | 2/1980 | Russell | 206/281 |
| 4,718,554 | A * | 1/1988 | Barbato | 206/477 |
| 4,811,852 | A * | 3/1989 | Kelly | 211/119 |
| 5,013,004 | A * | 5/1991 | Wilkins et al. | 248/692 |
| 5,664,669 | A * | 9/1997 | VanFleet | 206/6.1 |
| 6,032,793 | A * | 3/2000 | Oakley | 206/296 |
| 6,237,762 | B1 * | 5/2001 | Faircloth | 206/299 |
| 2004/0112772 | A1 * | 6/2004 | Kimura | 206/297 |

* cited by examiner

*Primary Examiner*—Mickey Yu
*Assistant Examiner*—Steven A. Reynolds
(74) *Attorney, Agent, or Firm*—Leason Ellis LLP

(57) ABSTRACT

A display unit for combining a first and second fabric fashion accessory such as a necktie includes a substrate having first and second panels arranged along an axis, a fold at the union of the first and second panels, a first hole disposed proximate to or at the fold in the substrate, and a securement that holds the first and second panels to one another to preserve the fold, a hanger seated in the first hole comprising a hook and a downwardly depending neck, and a flap attached to the first panel, the flap capable of extending around the entire display unit to be secured to the back of the first panel. A method for combining fabric fashions is provided as well.

10 Claims, 15 Drawing Sheets

FIGURE 5
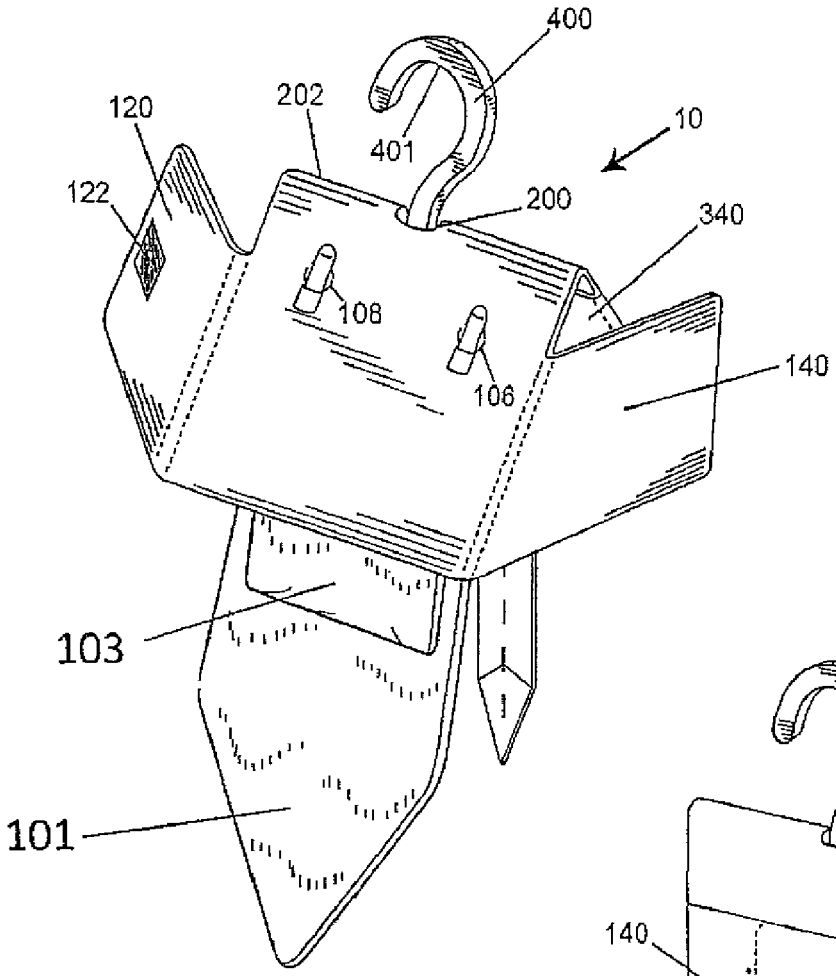
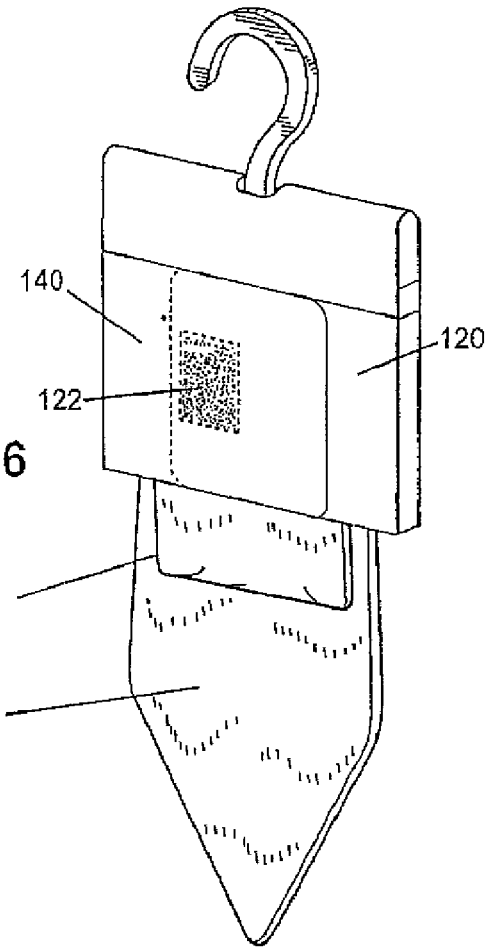
FIGURE 6

10
90
890
891
A
800
880
810
811
812
813
814
815
816
817
818
819
820
830
840
850
860
870
870a
870b
801
802
803
804
805
806

400
812
820
802
891
800
890
814
811
10
804
840
810
816
860
804
803
801
830
870b
813
819
880
817
850
870a
818
815
1000
805

METHOD AND APPARATUS FOR DISPLAYING CLOTHING AND CLOTHING ACCESSORIES

CROSS REFERENCE TO PRIOR APPLICATION

This application is a continuation-in-part of U.S. patent application Ser. No. 11/222,039, filed Sep. 7, 2005, entitled "Display Unit Adapted to Secure Cuff Links," which is a continuation-in-part of U.S. patent application Ser. No. 11/216,268, filed Aug. 30, 2005, entitled "Tie & Handkerchief Retail Display Unit," which are hereby incorporated by reference as if set forth in its entirety herein.

FIELD OF THE INVENTION

The present invention relates to packaging, and more particularly to retail display units for clothing and clothing accessories.

BACKGROUND OF THE INVENTION

It is generally desirable in the sale of fashion items and accessories to present the merchandise in a manner that permits potential customers to have a good look at the products. It is also important for retailers to be able to maintain the orderly condition of their wares so that their displays remain attractive to passersby. Packaging is conventionally selected to address these needs; however, special considerations come into play when selling multiple products together, such as when selling a necktie and handkerchief in combination, or when selling fabric fashion accessories such as neckties and handkerchiefs with cuff links or other jewelry. For example, it is desirable to permit them to be priced and sold as a unit and to prevent separation of one from the other. There is a need in the art for improved display units adapted to the sale of such combinations. The present invention satisfies these and other needs.

SUMMARY OF THE INVENTION

In accordance with one aspect of the present invention, a display unit for a tie and handkerchief is provided which comprises a substrate having at least first and second panels that are arranged adjacent one another along an axis. A first pair of flaps is attached to the first panel on opposing sides of the axis and are connected for pivotal movement in a first direction that is generally parallel to the axis. A second pair of flaps are attached to the second panel, on opposing sides of the axis, and are also pivotal in the first direction. A fold is defined at the union of the at least first and second panels, and a hole is disposed proximate to or at the fold. A securement holds the at least first and second panels in a closed configuration with the tie and handkerchief disposed in the display unit. A hanger is seated in the hole and includes a hook for mounting the display unit to a display, a neck depending downwardly from the hook, and an engagement surface which seats the hanger within the substrate.

In accordance with a more particular aspect of the embodiment of the invention, the engagement surface of the hanger includes opposing shoulders, each of which has a slot that extends toward one another. In this aspect, top and bottom portions of the shoulders receive a portion of the substrate within the respective slots to thereby engage the hanger to the substrate.

In accordance with a further aspect of the invention, a method for combining a necktie and handkerchief into a display unit is provided. The method comprises the steps of disposing the handkerchief and the tie on a substrate of the display unit. The substrate has a first and second panel, such as described above. A first pair of flaps extending from a panel are secured to one another over the combined tie and handkerchief. The first panel is folded so as to overlie the second panel with the handkerchief and tie disposed therebetween. The first and second panel are secured to one another to complete the combination. In a preferred method, a hanger is coupled to the substrate.

In accordance with another aspect of the invention, a display unit for securing jewelry together with a fabric fashion accessory is provided which comprises a substrate having at least first and second panels that are arranged adjacent one another along an axis. A first pair of flaps is attached on opposing sides of the axis and are connected for pivotal movement in a first direction that is generally parallel to the axis. A fold is defined at the union of the first and second panels, and a first hole is disposed proximate to or at the fold. A securement holds the at least first and second panels in a closed configuration with the fabric fashion accessory(ies) and any jewelry disposed in and projecting from the display unit. A hanger is seated in the first hole and has a hook for mounding the display unit to a display, and a neck depending downwardly from the hook and extending through the first hole. A pair of second holes extend through only one of the at least first and second panels and is sized to receive a stem of a piece of jewelry. In accordance with a more particular aspect, the display unit can but need not include a reinforcement which has a pair of third holes disposed in register with the pair of second holes and sized so as to receive the stem of the jewelry.

In accordance with another aspect of the invention, a method for combining jewelry and a fabric fashion accessory into a display unit is provided which comprising the steps of disposing the fabric fashion accessory on a substrate of the display unit. The substrate has a first panel and a second panel, such as described above. A pair of flaps extend from the second panel of the substrate and are secured to one another over the fabric fashion accessory to complete the display unit. A stem of the jewelry is inserted through a respective hole in one of the first and second panels while in an unengaged position, and the stem is then moved to the engaged position. The second panel is folded so as to overlie the first panel with the fabric fashion accessory disposed therebetween prior to securing the first panel to the second panel. In a preferred method, a hanger is coupled to the substrate.

In accordance with another aspect of the invention, a display unit for at least a pair of fabric fashion accessories, such as two ties, is provided which comprises a substrate having at least first and second panels that are arranged adjacent one another along an axis. A first pair of flaps is attached to the first panel on opposing sides of the axis and is connected for pivotal movement in a first direction that is generally parallel to the axis. A fold is defined at the union of the first and second panels, and a first hole is disposed proximate to or at the fold. A securement holds the at least first and second panels in a closed configuration with the fabric fashion accessories. A hanger is seated in the first hole and has a hook for mounding the display unit to a display, and a neck depending downwardly from the hook and extending through the first hole. In a preferred embodiment, the first panel comprises a flap capable of extending around the display unit with the pair of fabric fashion accessories therebetween and is secured to the back of the first panel. Additionally, a second and third pair of flaps are attached to the first panel on opposing sides of the axis further securing the pair of fabric fashion accessories within the display unit. In another embodiment, the display twit comprises a pair of holes through at least the first and second panels for receiving the stem of a piece of jewelry, enabling the jewelry to be combined with the pair of fashion fabric accessories, such as cufflinks, in the display unit.

In accordance with still another aspect of the invention, a method for combining a pair of fabric fashion accessories, such as a pair of ties, into a display unit is provided which comprises the step of disposing the pair of fabric fashion accessories on a substrate of the display unit. The substrate has a first panel and a second panel, such as described above. The second panel is folded so as to overlie the first panel. A pair of flaps extends from the first panel of the substrate and is secured to one another over the pair fabric fashion accessories to complete the display unit. In a preferred method, a flap extends from the first panel and is wrapped around the entire display unit with the fabric fashion accessories therebetween, and is secured to the back of the first panel. Additionally, a second and third pair of flaps extend from the first panel of the substrate and are secured to one another respectively with the pair of fabric fashion accessories disposed therebetween, allowing for a portion of the first fabric fashion accessory to extend above the second fabric fashion accessory, thus giving a buyer ample view of both fabric fashion accessories. In yet another preferred method, a stem of a piece of jewelry is inserted through a second pair of holes, allowing the jewelry to be combined with the pair of fabric fashion accessories and secured to the display unit.

BRIEF DESCRIPTION OF THE DRAWINGS

FIG. 5 is a perspective view of the display unit with flaps in the first position.

FIG. 6 is a rear perspective view of the display unit with flaps folded into the second position.

DETAILED DESCRIPTION OF CERTAIN EMBODIMENTS

By way of overview and introduction, a present invention provides a display unit 10 for securing a tie and handkerchief together for presentation to potential customers. The display unit 10 secures the tie and handkerchief so as to permit them to be priced and sold as a unit, and so as to prevent separation of one from the other. More generally, the present invention provides a display suitable for securing various fabric fashion accessories to articles of jewelry for presentation to potential customers. Thus, a display unit in accordance with the invention can secure, by way of example, a necktie and a pair of cufflinks together, a necktie and handkerchief combination together with a pair of cufflinks, or a handkerchief or scarf together with a pin or broach. For ease of discussion, a display unit principally adapted to secure a necktie and handkerchief is described. However, it is to be understood that one or more features can be omitted or combined with other features in order to implement a display unit suitable for securing together particular fabric fashion accessories and/or jewelry.

Figure 1:
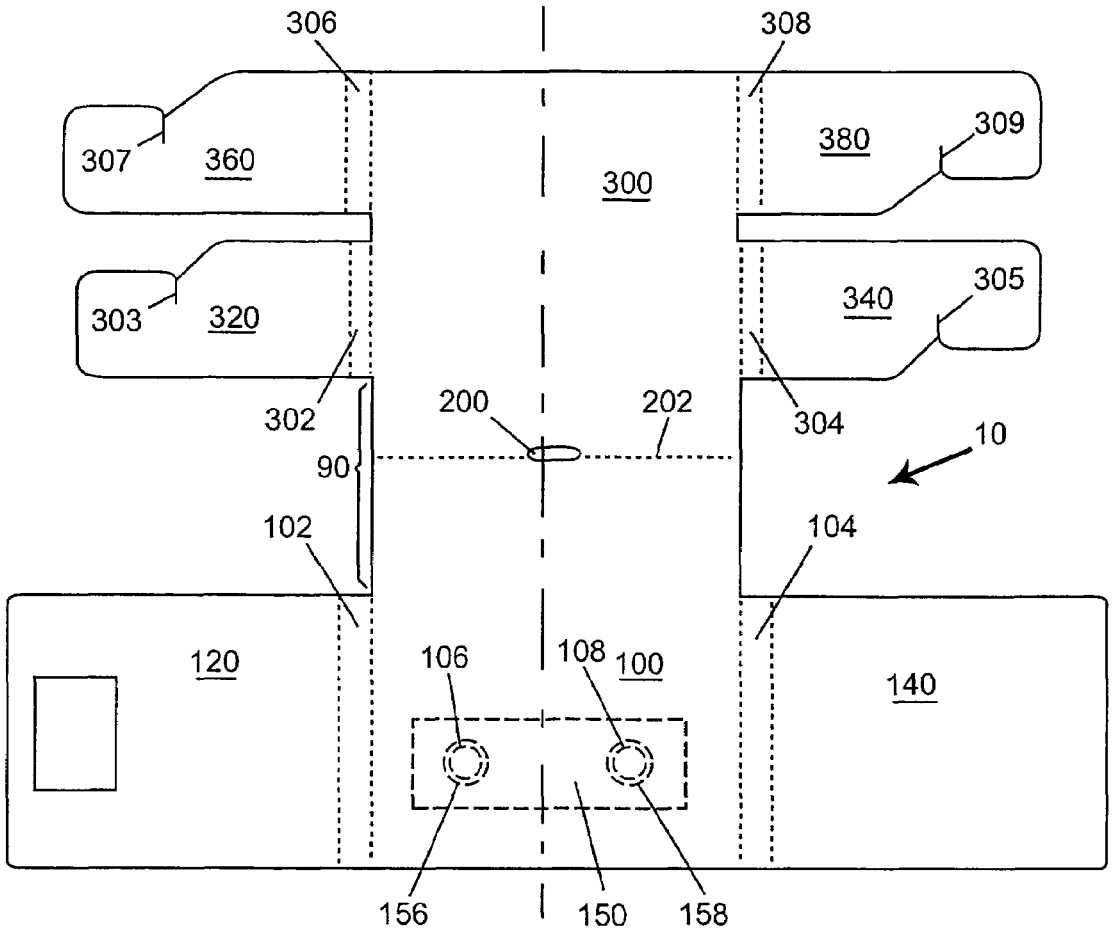
FIG. 1 is an inside top plan view of the display unit in accordance with a preferred embodiment.

Referring now to FIG. 1, the display unit 10 that comprises a substrate 90 having a first panel 100 and a second panel 300 arranged along an axis A upon which the tie and handkerchief (not shown) are to be disposed. The entire display unit 10 can be composed of cardboard or any other material that can flex about a fold 202. In the illustrated embodiment, flaps 320, 360 extend from the second panel 300 on one side of the axis A and flaps 340, 380 extend from the opposite side of the axis A. Flaps 320, 360 can instead comprise a single flap, and flaps 340, 380 can also comprise a single flap. A single flap is particularly suitable when the only fabric fashion accessory being secured within the display unit 10 is a necktie or a handkerchief; however, a single flap can be used to secure both a necktie or a handkerchief, if desired.

Preferably, the flaps have notches 303, 305, 307, 309, as illustrated, which affix opposing flaps 320, 340 and 369, 380 together. Instead of notches, the flaps can be affixed with other securements such as a crimp, glue, tape, or other arrangements of fingers and slots than as illustrated.

Each of these flaps 320, 340, 360, 380 preferably can fold or pivot generally parallel to the axis A at 302, 304, 306, 308. Such movement of the panels better accommodates the thickness of the fabric fashion accessory (e.g., the tie and/or handkerchief).

The display unit 10 also comprises a hole 200 in the union of the first and second panels to be used by the hanger 400, described below. Preferably, the hole 200 is aligned with the fold 202 so that the hanger 400 projects directly from a top margin of the display unit 10, when folded at 202 (see FIG. 5).

Referring again to FIG. 1 the first panel 100 includes first flaps 120, 140 extending from opposing sides of the first panel 100 on either side of the axis A. Preferably, each flap 120, 140 is pivotal about folds 102, 104 in a direction generally parallel to the axis A so as to move from a first position disposed away from the axis A (as shown in FIG. 5) to a second position that abuts or overlies the first panel (as shown in FIG. 6). As illustrated (in FIG. 5), flap 120 has a securement 122 usable to secure the first and second panels in the folded position shown in FIG. 6.

Figure 2:
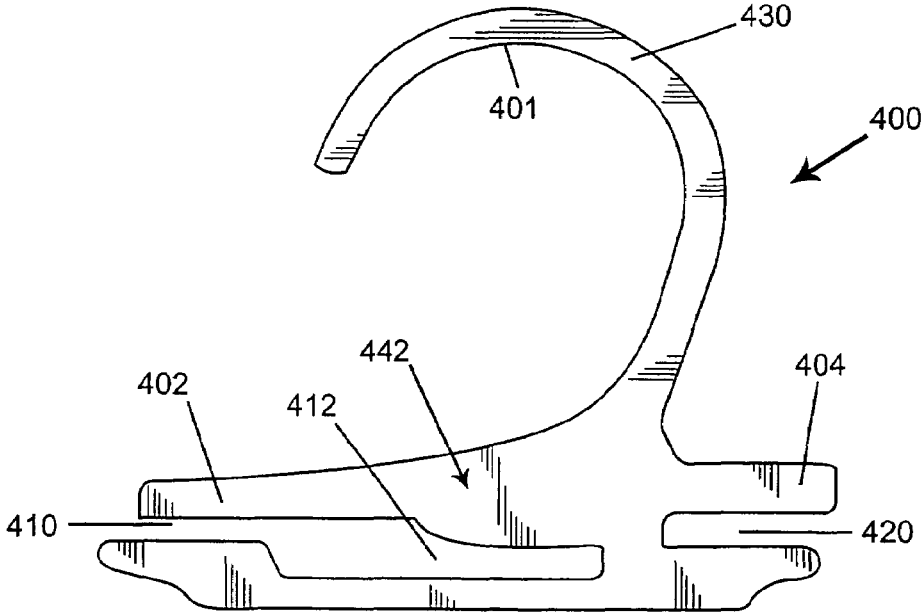
FIG. 2 is a side plan view of the hanger in accordance with the preferred embodiment.

As illustrated in FIG. 2, the hanger 400 comprises a hook 401 and a neck 430 extending downwardly toward an engagement surface which can be larger than the hole 200 in at least one dimension in order to secure the hanger to the substrate 90. The neck 430 extends the hook 401 above the fold line 202 to facilitate hanging the display unit 10. In an alternative arrangement, the engagement surface comprises a separate component which can be mounted to the neck after having disposed the neck through the hole 200, as described below.

As shown in FIG. 2, the engagement surface can comprise first and second shoulders 402, 404. The shoulders each have top and bottom surfaces with a slot 410, 420 therebetween. The slot extends toward each other to a depth, leaving a base 442 that connects the shoulder portions to the neck 430. An internal cavity 412 is in communication with and is sized to permit engagement of the hook in the hole so that the top and bottom portions can be seated on opposing sides of the substrate 90.

Figure 3:
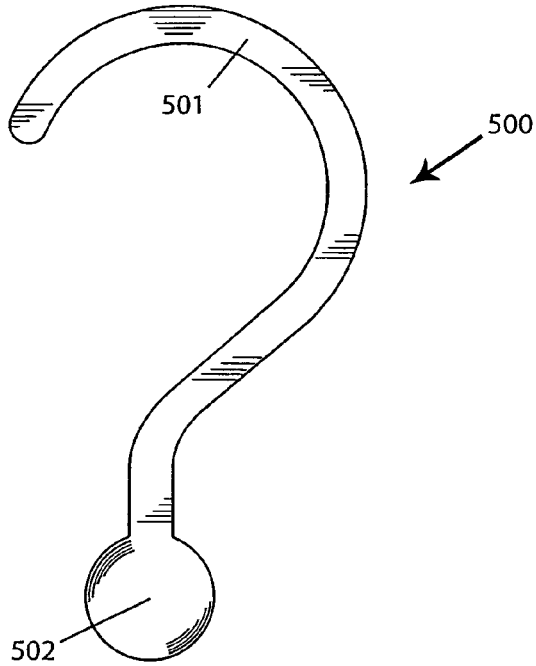
FIG. 3 is a side plan view of a first variation of the hanger of FIG. 2.

A variation of the engagement surface 440 is shown in FIG. 3 and has a hook 501 and a bulbous end 502 at the bottom of the hanger 500 sized to be urged through the hole 200 in the display unit 10 in at least one dimension and stay seated therein while overcoming the weight of the tie, handkerchief and display unit 10. In other words, the hole 200 is somewhat smaller than the center of the bulbous end 502 in at least one dimension.

Figure 4:
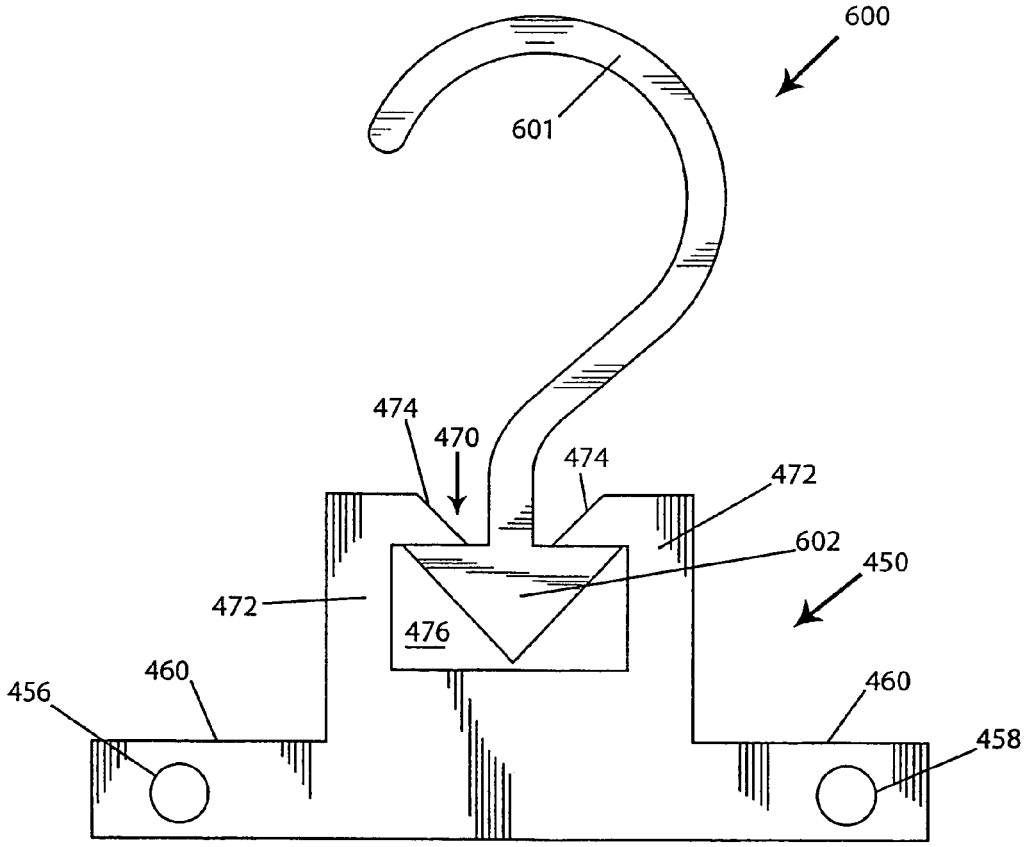
FIG. 4 is a side plan view of a second variation of the hanger of FIG. 2.

Another variation of the engagement surface 440 is shown in FIG. 4 and has a hook 601 and a pointed end 602 at the bottom of the hanger 600 sized to be urged through the hole 200 in the display unit 10 in at least one dimension and stay seated therein while overcoming the weight of the tie, handkerchief and display unit 10. In other words, the hole 200 is somewhat smaller than a portion of the pointed end 602 in at least one dimension.

Referring again to FIGS. 1 and 5, the first panel 100 has holes 106, 108 which are optionally provided in order to seat a pair of cufflinks. As can be appreciated, fewer or additional holes can be provided, as appropriate to seat a particular jewelry item. The holes are in the first panel 100 but not the second panel 300 so that the jewelry can be mounted to the display unit 10 with its clasp or closure mechanism disposed between the first and second panels when the panels are connected to one another. In this way, the jewelry is secured to the display unit so as to impede separation of the jewelry from the display unit.

FIG. 1 further illustrates a reinforcement member 150 which can be disposed within the display unit. The reinforcement member 150 includes at least holes 156, 158 which are in register with the holes 106, 108. The clasp or stem of the jewelry to be mounted on the display unit 10 (e.g., the stem of a cufflink) is passed through the holes 106, 108 of the panel 100 and through the holes 156, 158 of the reinforcement member 150 while in an unengaged position and then moved to an engaged position in which the jewelry is secured to the display unit. As shown in FIG. 5, a pair of cufflinks, for example, has its adorned surface projecting from the panel 100 and its stem passing through the panel for engagement on the inner surface of the panel shown in FIG. 1. The reinforcement member 150, if provided, makes it more difficult for a person to dislodge the jewelry from the display unit 10.

FIG. 4 illustrates an alternative to the reinforcement member 150 of FIG. 1. A reinforcement member 450 has holes 456, 458 that are in register with holes 106, 108 of the first panel 100. In addition, the reinforcement member 450 can serve as an engagement surface 460 to engage the substrate 90 when the hanger 600 is inserted into the hole 200. This is appropriate, for example, when the pointed end 602 at the bottom of the hanger 600 is sized relative to the hole 200 (e.g., smaller than the hole) such that a further component is needed to support the weight of the articles being contained in the display unit 10. The reinforcement member 450 has a catch 470 which securely receives and retains the pointed end 602 of the hanger 600. The catch 470 preferably comprises a pair of resilient fingers 472 at least one of which has a chamfered edge 474 that resistively flexes in response to advancement of the wide portion of the pointed end 602 into a cavity 476, yet resiliently restores to a rest position after a trailing edge 604 of the pointed end 602 has been urged passed the chamfered edges 474 (as shown). In use, the reinforcement member 450 is disposed on the inner surface of the substrate 90 shown in FIG. 1, the pointed end 602 (or bulbous end 502 of FIG. 3) is inserted through the hole 200 from the opposite side of the substrate, and the pointed (or bulbous) end is seated within the cavity 476.

Figure 7:
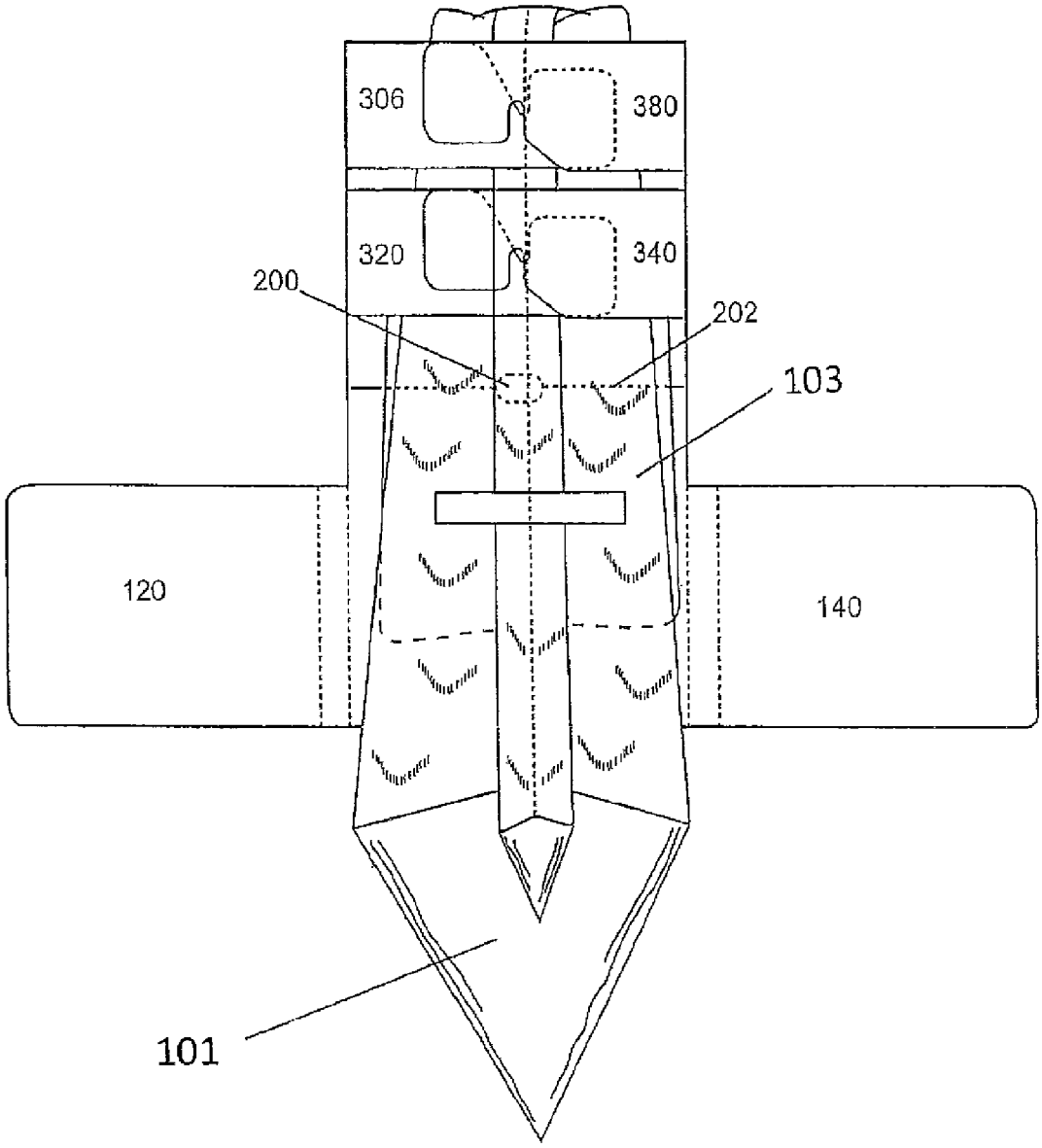
FIG. 7 is an inside top plan view of the embodiment of FIG. 1 illustrating a tie and a handkerchief when disposed thereupon.

A method for combining a necktie 101 and handkerchief 103 into a display unit 10 can comprise the following steps. The handkerchief 103 is first disposed onto the substrate 90 with the panels 320-380 in the first position (as shown in FIG. 1). The flaps 360, 380 are folded on top of the handkerchief 103 into the second position and secured together (see FIG. 7). Preferably, the top portion of the handkerchief 103 is then folded over the flaps 360, 380. The necktie 101 is then disposed on top of the handkerchief 103 and the flaps 360, 380 also onto the substrate 90. The flaps 320, 340 are then folded on top of the necktie 101 into the second position and secured together (as shown in FIG. 7). The second panel 300 is then folded along the fold 202 as to overlie the first panel 100 with the handkerchief 103 and necktie 101 disposed therebetween. The first flaps 120, 140 are then folded over the now connected first panel 100 and second panel 300 and secured using the securement 122 (as shown in FIG. 6).

At one point in the process, the engagement surface of the hanger 400 is brought into contact with the substrate to complete the display unit.

Cufflinks or other jewelry are preferably mounted to the display unit before the panels of the display unit are connected to one another. As noted above, cufflinks or other articles of jewelry can be mounted to the display unit with a variety of fabric fashion accessories, including neckties, handkerchiefs, scarves, and combinations of various fabric fashion accessories. The jewelry is in an "unengaged" position when it is configured to be attached to an article of clothing and is in an "engaged" position when its clasp or stem have been oriented to secure the jewelry to the article of clothing.

Figure 8:
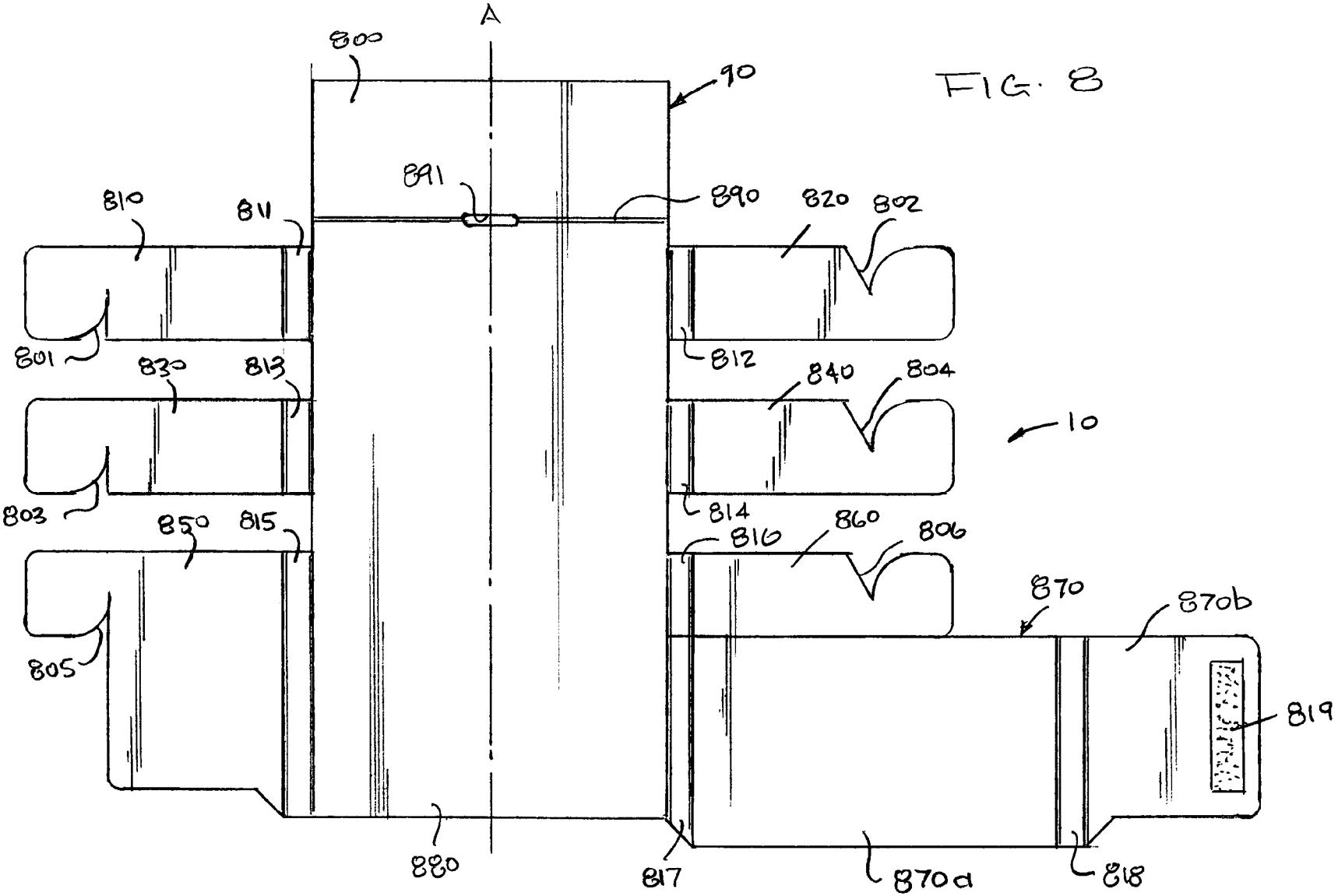
FIG. 8 is an inside top plan view of the display unit in accordance with a second embodiment.

Referring now to FIG. 8, a second embodiment for displaying a pair of ties 1000, 2000 and an optional fabric fashion accessory, such as a handkerchief 4000, is shown. The display unit 10 comprises a substrate 90 having a first panel 800 and a second panel 880 arranged along an axis A upon which the pair of ties and any other fabric fashion accessory, such as a handkerchief, are to be disposed. The entire display unit 10 can be composed of cardboard or any other material that can flex about a fold 890. In the illustrated embodiment, flaps 810, 830, 850 extend from the second panel 880 on one side of the axis A and flaps 820, 840, 860, 870 extend from the second panel 880 on the opposite side of the axis A. Flaps 810, 830 can instead comprise a single flap, and flaps 820, 840 can also comprise a single flap.

Preferable, the flaps have notches 801, 802, 803, 804, 805, 806, as illustrated, which affix opposing flaps 810, 820 and 830, 840 and 850, 860 together. As discussed previously, the flaps can be affixed with other securements other than the illustrated slots and notches. Additionally, each of the flaps 810, 820, 830, 840, 850, 860 preferably can fold or pivot generally parallel to the axis A at 811, 812, 813, 814, 815, 816 to accommodate the thickness of the two ties 1000, 2000 and the optional handkerchief 4000.

The display unit 10 comprises a hole 891 in the union of the first and second panels to be used by the hanger 400, as described above. Preferably, the hole 891 is aligned with the fold 890 so that the hanger 400 projects directly from a top margin of the display unit 10 when folded at 890.

Figure 16:
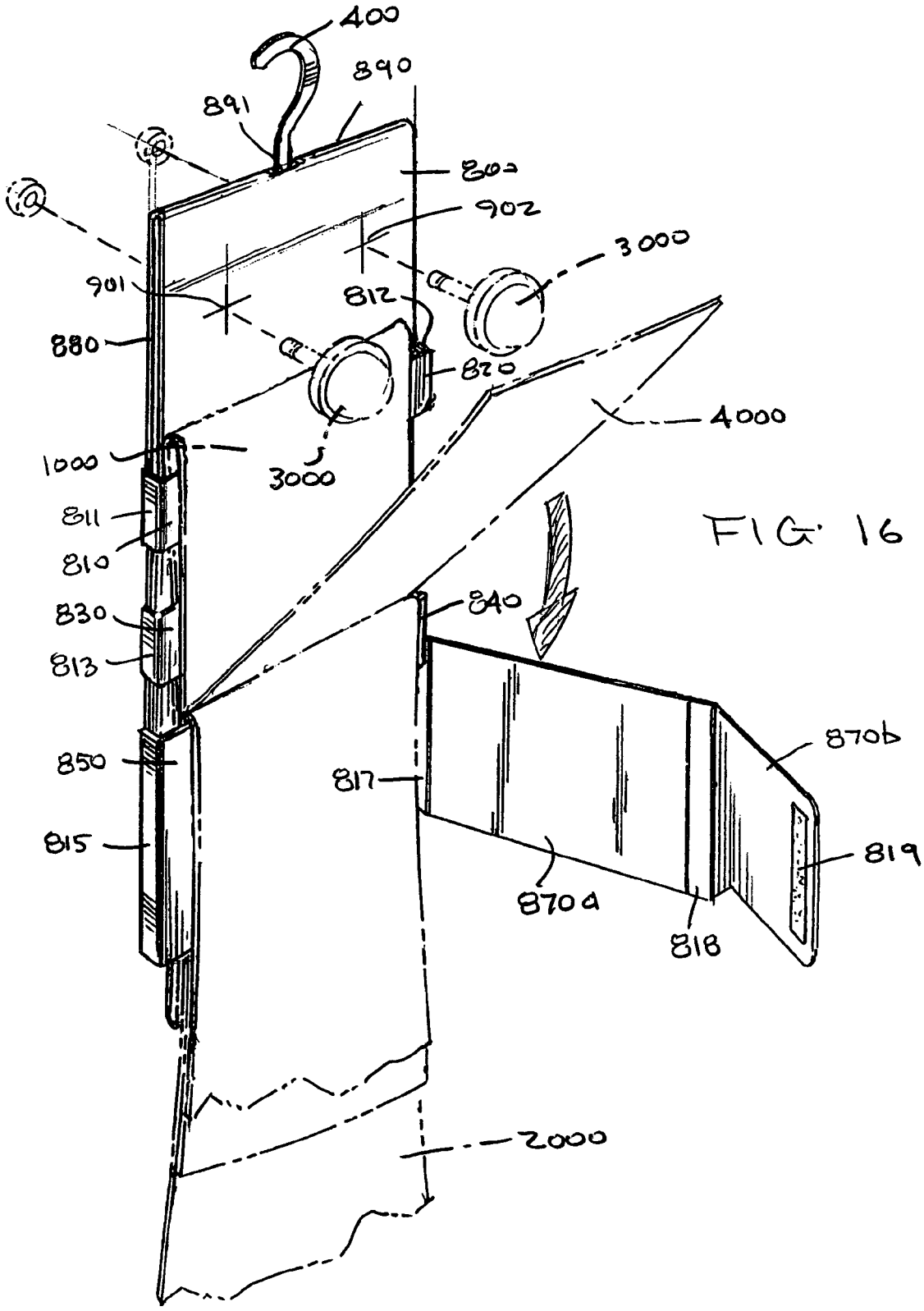
FIG. 16. is a front perspective view of the third embodiment illustrating a pair of cufflinks and an optional handkerchief when disposed thereupon.
Figure 17:
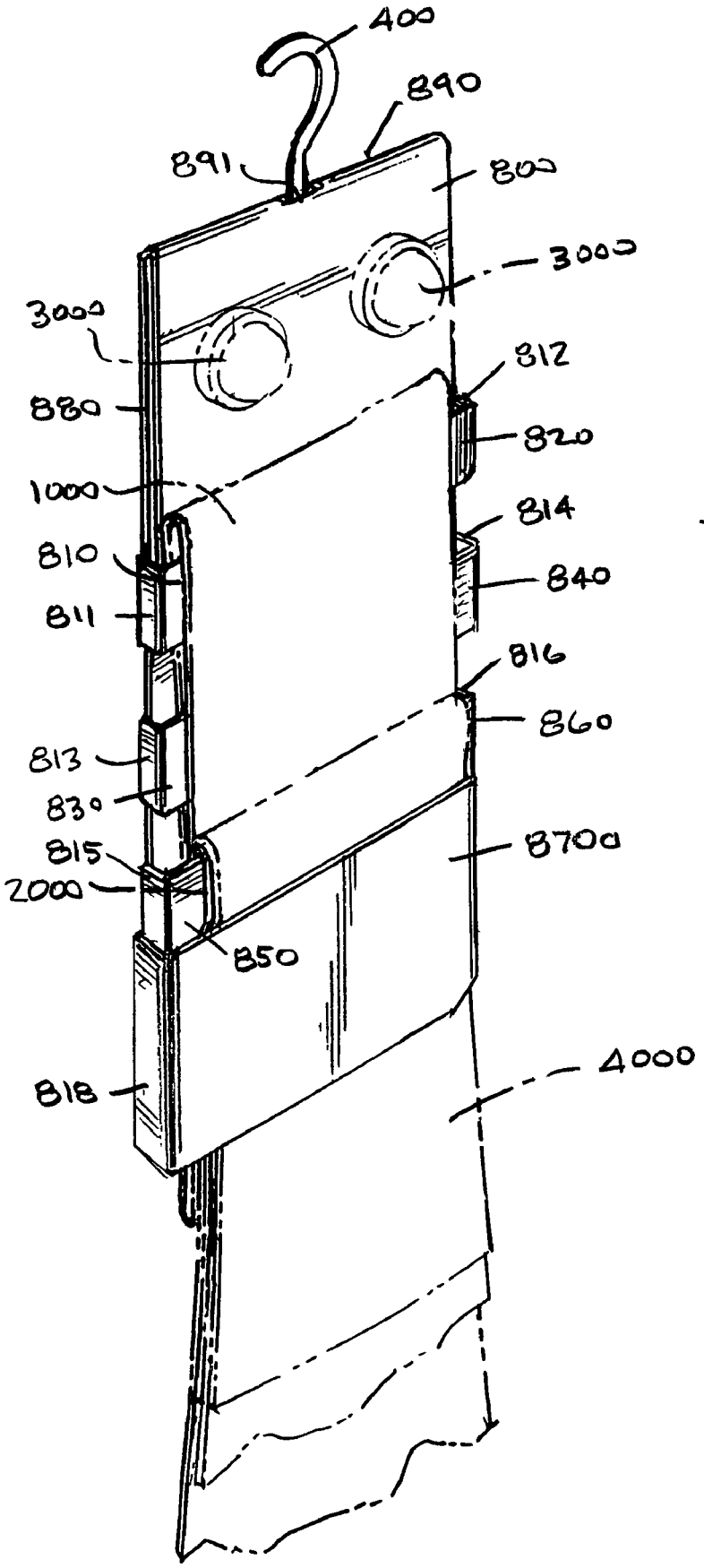
FIG. 17. is a front perspective view of the third embodiment illustrating a pair of cufflinks and an optional handkerchief.
Figure 18:
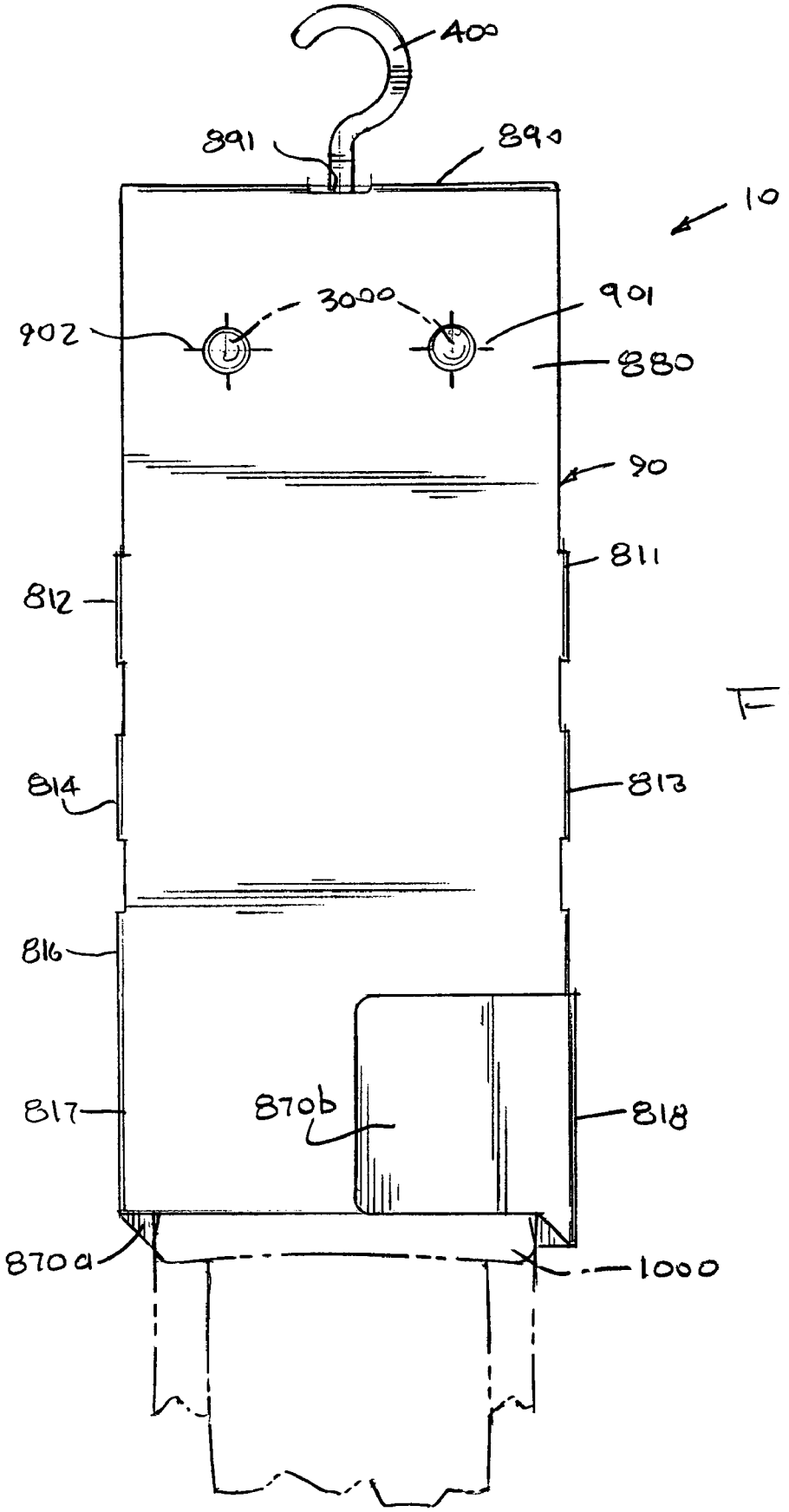
FIG. 18 is a rear perspective view of the third embodiment illustrating a pair of cufflinks and a pair of ties when disposed thereupon with the flap in a secured position.

In the second embodiment of the display unit, a flap 870 extends from the second panel 880. The flap 870 preferably comprises two sections, 870*a* and 870*b*, which are pivotal about folds 817 and 818 in a direction generally parallel to the axis A so as to move from a first position disposed away from the axis A (as shown in FIG. 16) to a second position that overlies the second panel 880 (as shown in FIGS. 17 and 18). As illustrated in FIG. 8, flap 870 has a securement 819 usable to secure the flap 870 to the second panel 880 as shown in FIG. 18.

Figure 14:
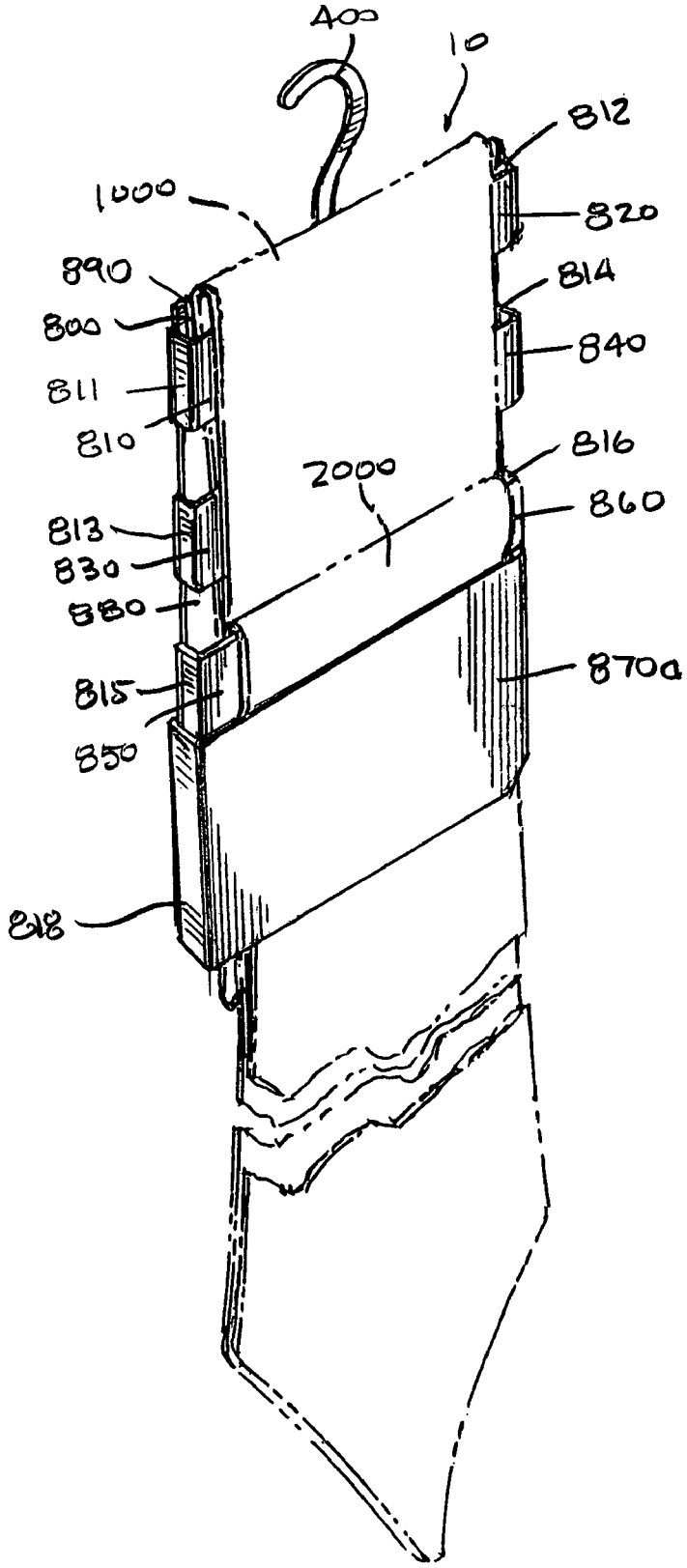
FIG. 14. is a front perspective view of the second embodiment illustrating a pair of ties when disposed thereupon.

FIG. 14 illustrates displaying a pair of ties 1000, 2000 according to the second embodiment. FIG. 16 illustrates the optional handkerchief 4000 being displayed with the pair of ties 1000, 2000.

Figure 9:
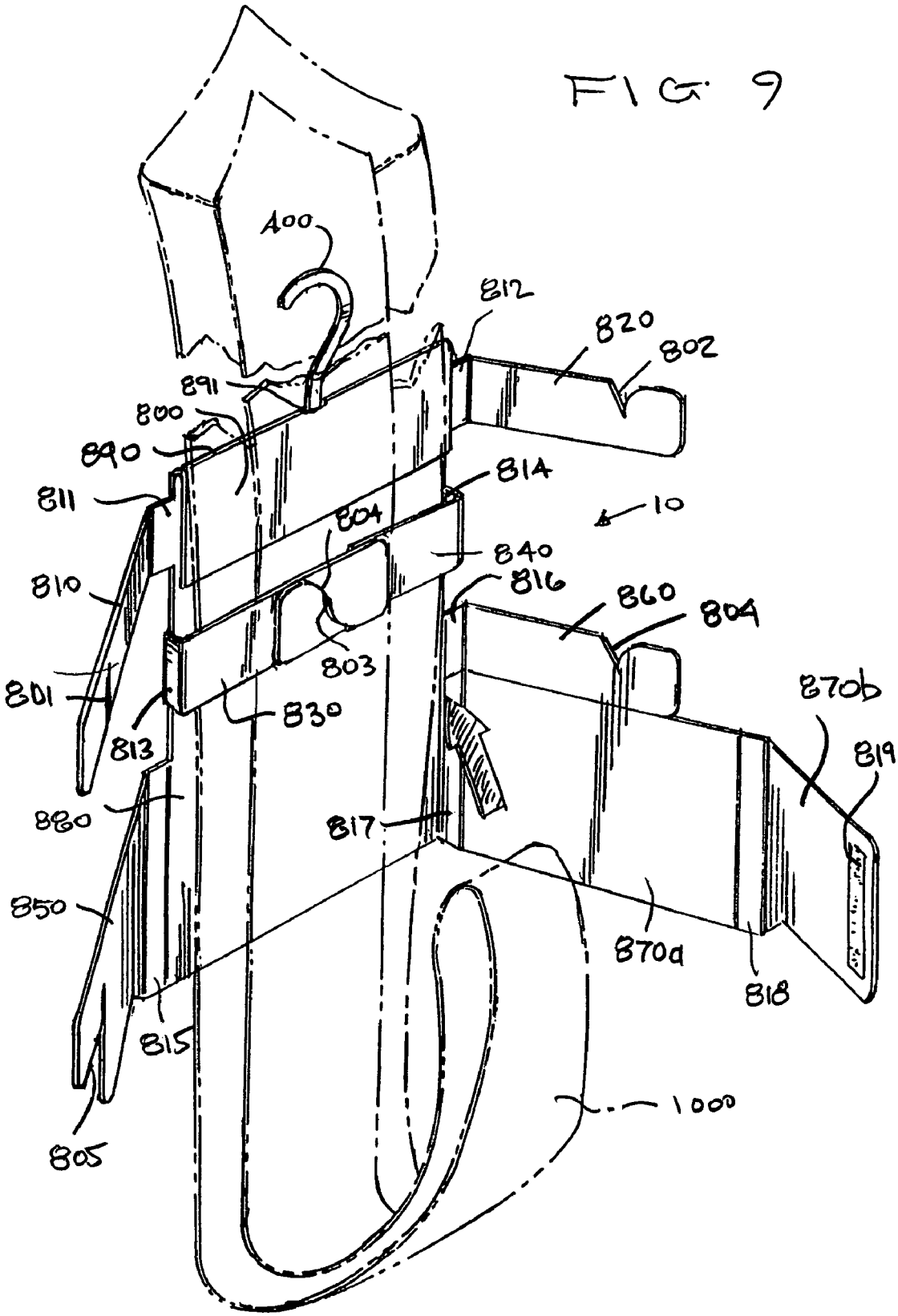
FIG. 9 is a front perspective view of the second embodiment illustrating a pair of ties when disposed thereupon with a pair of flaps in a sectored position.
Figure 10:
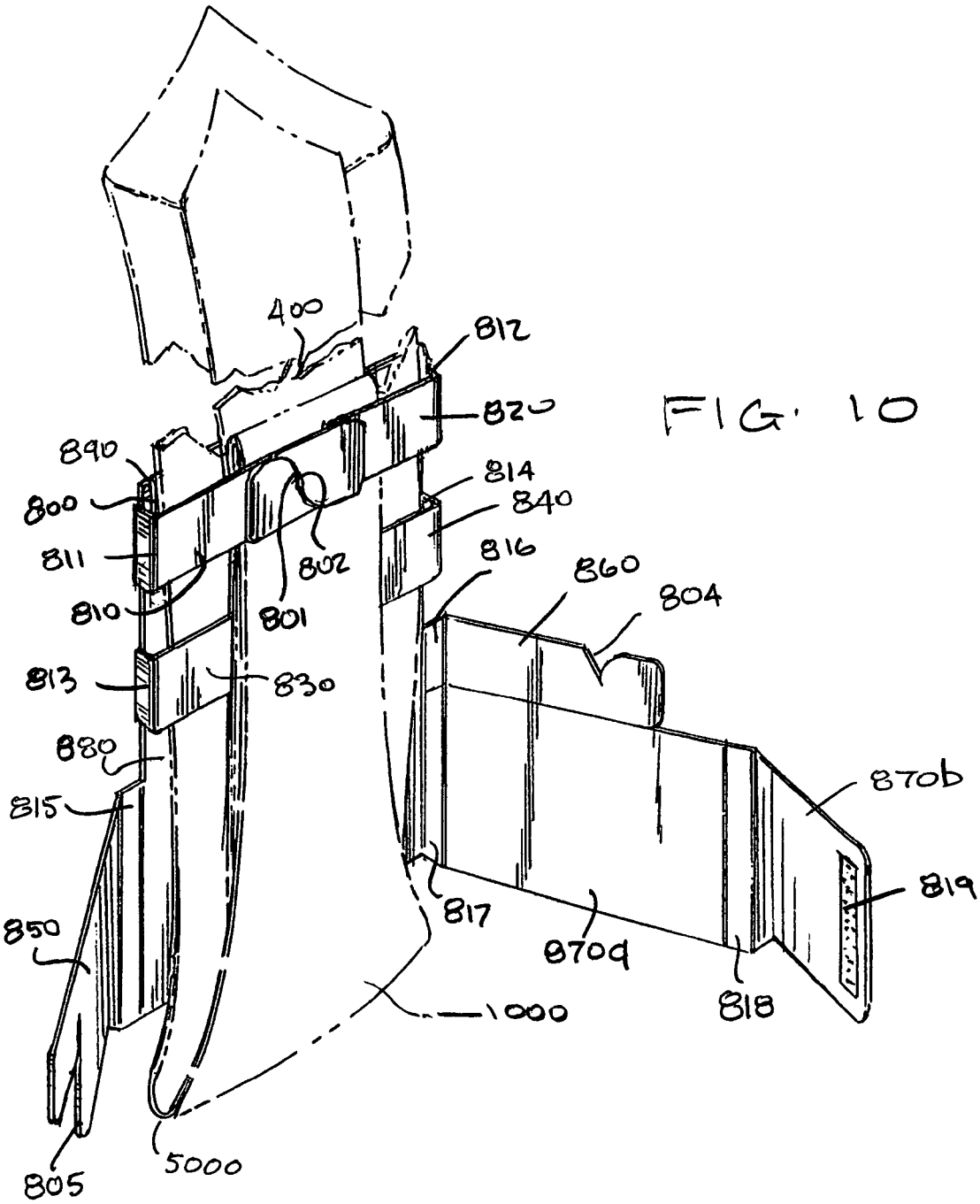
FIG. 10 is a front perspective view of the second embodiment illustrating a pair of ties when disposed thereupon with a pair of second flaps in a secured position.
Figure 11:
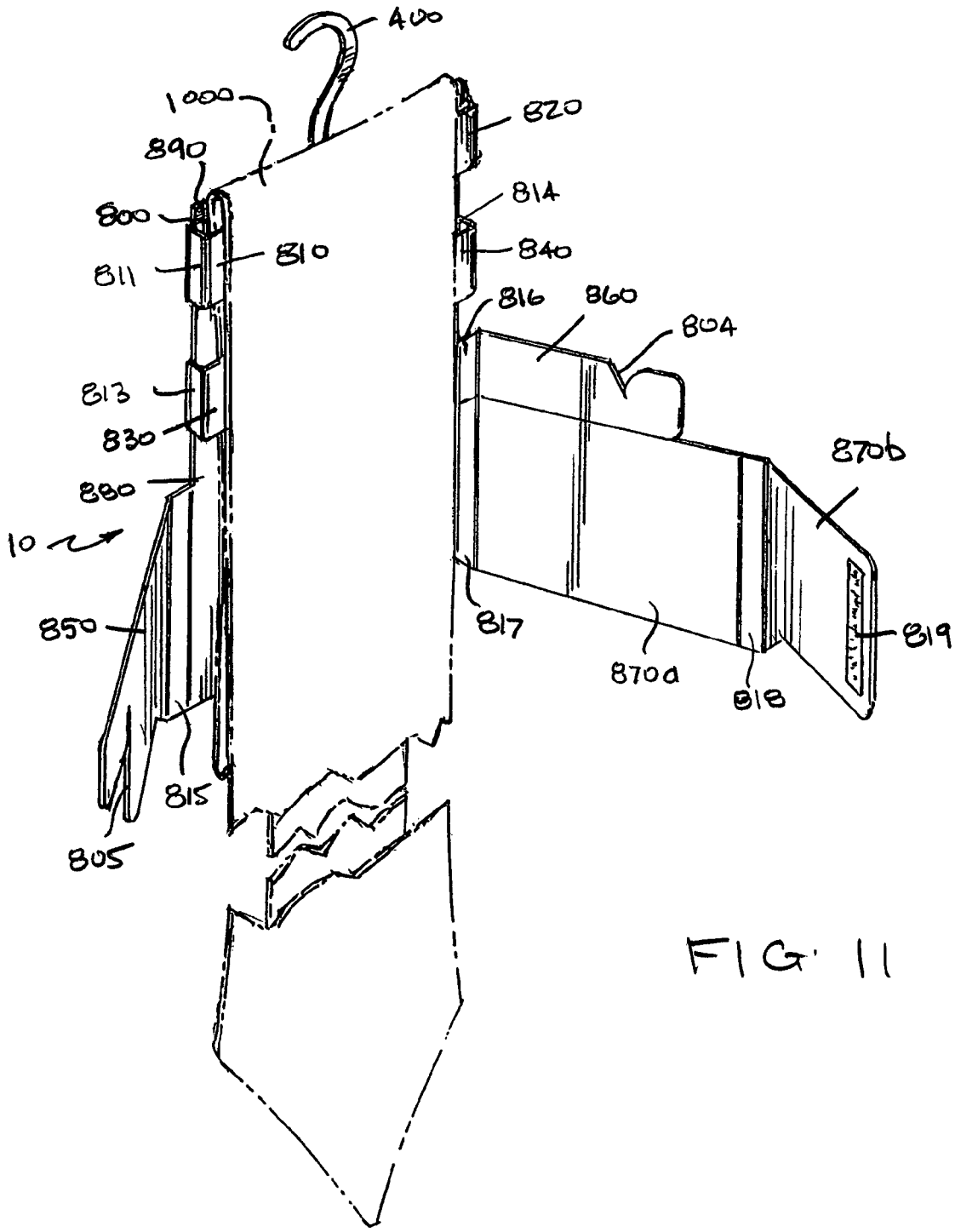
FIG. 11 is a front perspective view of the second embodiment illustrating a pair of ties when disposed thereupon with a pair of third flaps in an unsecured position.
Figure 12:
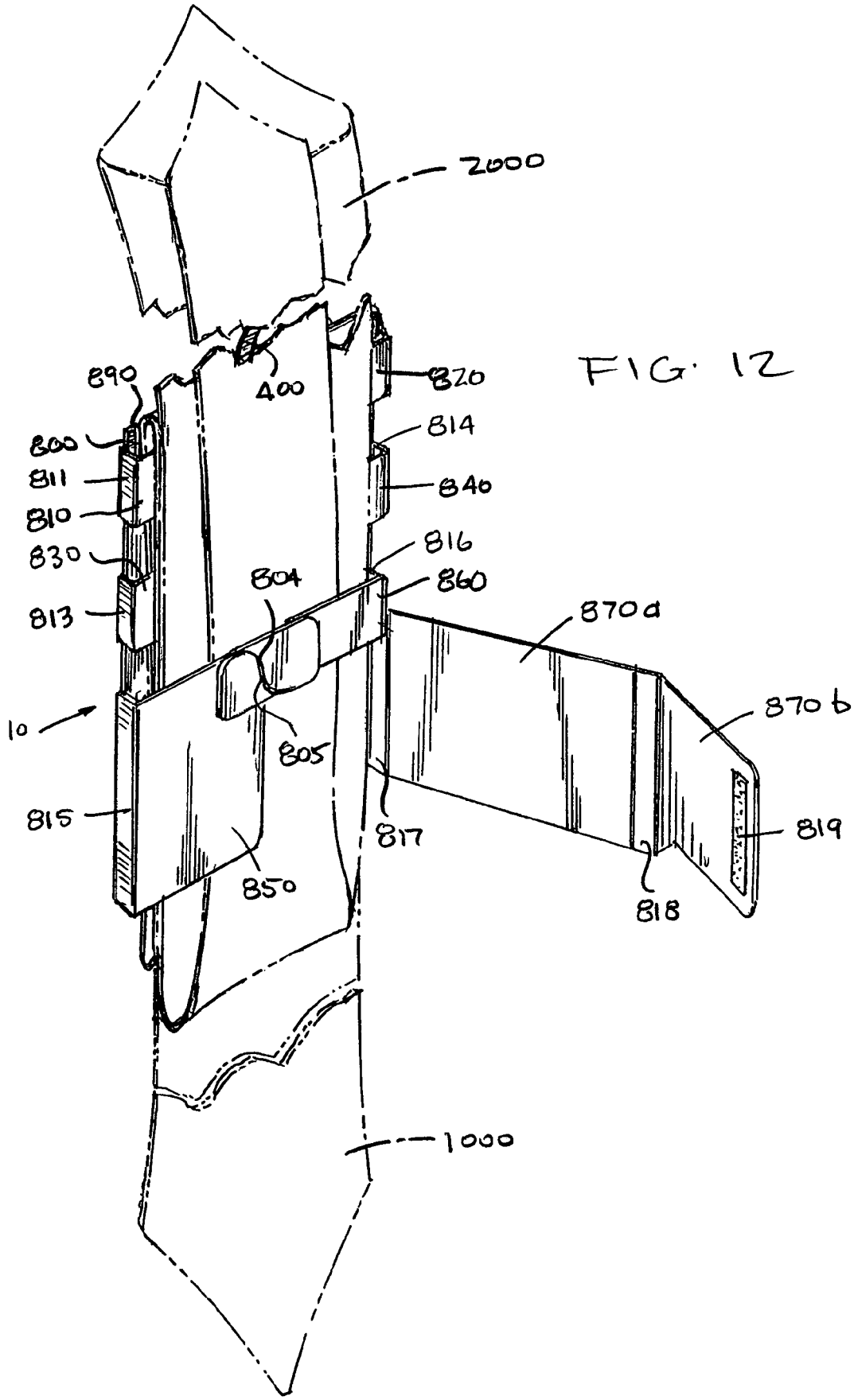
FIG. 12 is a front perspective view of the second embodiment illustrating a pair of ties when disposed thereupon with the pair of third flaps in a secured position.

A method for combining a pair of ties 1000, 2000 according to the second embodiment can comprise the following steps. The first tie 1000 is first disposed onto the substrate 90 with the flaps 810, 820, 830, 840, 850, 860, and 870 in the first position (as shown in FIG. 8). The flaps 830, 840 are folded on top of the tie 1000 into the second position and secured together as shown in FIG. 9. The bottom portion of tie 1000 is then folded over flaps 830, 840 and flaps 810, 820 are folded on top of the tie 1000 into the second position and secured together as shown in FIG. 10. The tie 1000 is then folded over flaps 810, 820 as shown in FIG. 11. The second tie 2000 is then disposed onto the substrate 90 on top of tie 1000 as shown in FIG. 12. Flaps 850, 860 are folded over the top of tie 2000 and secured together as shown in FIG. 12. Tie 2000 is then folded over flaps 850, 860 (see FIG. 13). Flap 870 is then folded around the display unit 10 and secured using securement 819 (see FIG. 14).

Figure 13:
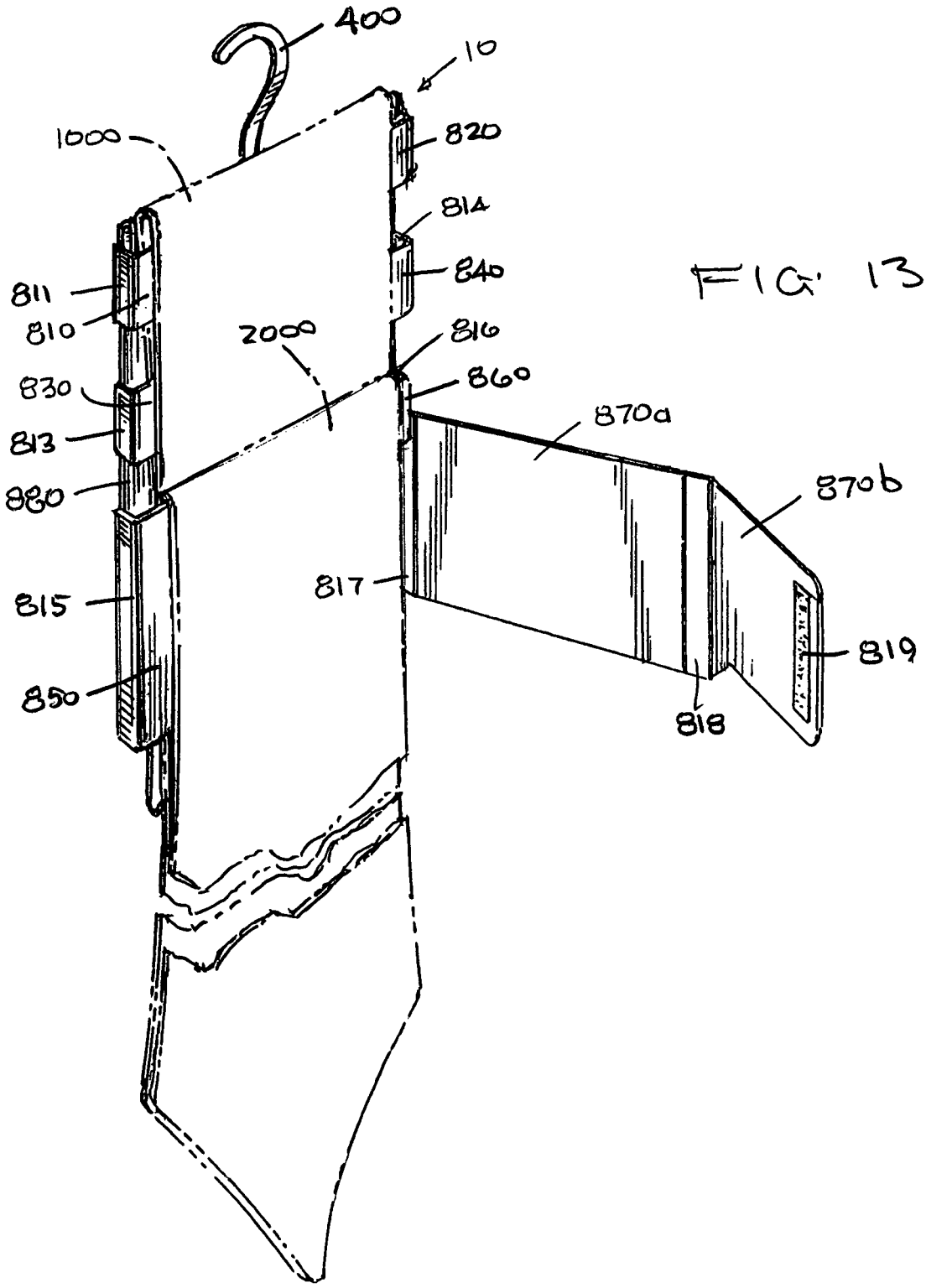
FIG. 13 is a front perspective view of the second embodiment illustrating a pair of ties when disposed thereupon with a flap in an unsecured position.

In a variation of the method described above, tie 1000 is disposed flat on substrate 90 and flaps 830, 840 are folded on top of tie 1000 into the second position and secured. Then, the portion of tie 1000 below flaps 830, 840 is folded up towards unsecured flaps 810, 820 and pulled through such that the fold 5000 is against the bottom edges of flaps 830, 840. Flaps 810, 820 are then folded on top of tie 1000 into the second position and secured. The entire tie 1000 is then folded downwards towards flap 870 to achieve the layout as shown in FIG. 11. Then, tie 2000 is disposed on top of tie 1000 and flaps 850, 860 are folded on top of tie 2000 into the second position and secured. The portion of tie 2000 above flaps 810, 820 is then folded downwards toward flap 870 to achieve the layout as shown in FIG. 13. Flap 870 is then folded around the display unit 10 and secured using securement 819 to achieve the layout as shown in FIG. 14.

In addition, an optional fashion fabric accessory, such as handkerchief 4000, can be displayed using the methods described above. Prior to the step of disposing the second tie 2000 onto the substrate 90, the handkerchief 4000 is disposed onto the substrate 90 on top of tie 1000. Then, tie 2000 is disposed onto the substrate 90 on top of handkerchief 4000. Flaps 850, 860 are secured as shown in FIG. 13. When the handkerchief 4000 and tie 2000 are folded over flaps 850, 860 (see FIG. 16), the handkerchief 4000 is displayed on top of tie 2000 as shown in FIG. 17.

Figure 15:
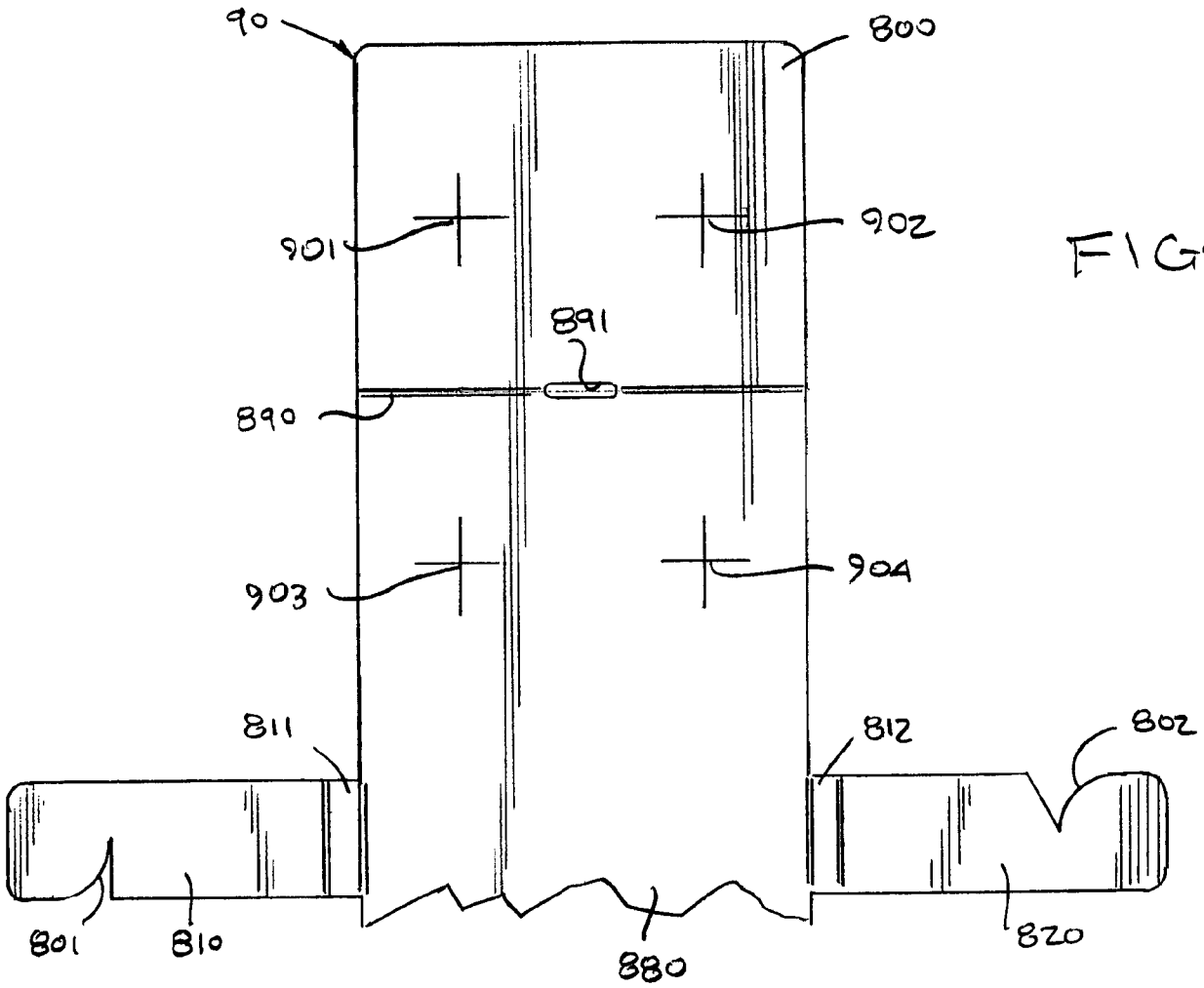
FIG. 15 is an inside top view of the third embodiment illustrating a pair of holes through the first and second panels.

Referring now to FIG. 15, a third embodiment of the display unit 10 for displaying a pair of ties 1000, 2000 and an optional fabric fashion accessory, such as a handkerchief 4000, along with a pair of cufflinks 3000, is illustrated. Similar to the second embodiment illustrated in FIG. 8, the display unit 10 comprises a substrate 90 having a first panel 800 and a second panel 880 arranged along an axis A upon which the pair of ties 1000, 2000 and the optional handkerchief 4000 are to be disposed. The entire display unit 10 can be composed of cardboard or any other material that can flex about the fold 890. Additionally, in this third embodiment, holes 901, 902 are disposed on the first panel 800. Corresponding holes 903, 904 are disposed on the second panel 880 so that when the entire display unit 10 is folded along fold 890, hole 901 aligns with hole 903 and hole 902 aligns with hole 904. Additionally, holes 901, 902 and 903, 904 preferably correspond with holes 456, 458 (as shown in FIG. 4) when using hanger 600.

FIGS. 16 and 17 illustrate displaying a pair of ties 1000, 2000 with a pair of cufflinks 3000 and the optional handkerchief 4000. The cufflinks 3000 are attached to the display unit through hole pairs 901, 903 and 902, 904.

A method for combining a pair of ties 1000, 2000 with jewelry, such as cufflinks 3000 according to the third embodiment can comprise the following steps. The first tie 1000 is first disposed onto the substrate 90 with the flaps 810, 820, 830, 840, 850, 860, and 870 in the first position (as shown in FIG. 8). The flaps 830, 840 are folded on top of the tie 1000 into the second position and secured together as shown in FIG. 9. The bottom portion of tie 1000 is then folded over flaps 830, 840 and flaps 810, 820 are folded on top of the tie 1000 into the second position and secured together as shown in FIG. 10. The tie 1000 is then folded over flaps 810, 820 as shown in FIG. 11. The second tie 2000 is then disposed onto the substrate on top of tie 1000 as shown in FIG. 12. Flaps 850, 860 are folded over the top of tie 2000 and secured together as shown in FIG. 12. Tie 2000 is then folded over flaps 850, 860 (see FIG. 13). Flap 870 is then folded around the display unit 10 and secured using securement 819 as shown in FIGS. 17 and 18. Cufflinks 3000 are inserted into hole pairs 901, 903 and 902, 904 (see FIG. 16).

In addition, an optional fashion fabric accessory, such as handkerchief 4000, can be displayed using the method described above. Prior to the step of disposing the second tie 2000 onto the substrate 90, the handkerchief 4000 is disposed onto the substrate 90 on top of tie 1000. Then, tie 2000 is disposed onto the substrate 90 on top of handkerchief 4000. Flaps 850, 860 are secured as shown in FIG. 12. When the handkerchief 4000 and tie 2000 are folded over flaps 850, 860 (see FIG. 16), the handkerchief is displayed on top of tie 2000 as shown in FIG. 17.

While the invention has been described in connection with certain embodiments thereof, the invention is capable of being practiced in other forms and using other materials and structures. Accordingly, the invention is defined without limitation by the recitations in the claims appended hereto and equivalents thereof.

What is claimed is:

1. A display unit for securing a fabric fashion accessory and for displaying articles of clothing, comprising:

a first tie;

a second tie;

a substrate having a first panel and a second panel arranged along an axis, a flap attached to the first panel of the substrate and being pivotal in a first direction that is generally parallel to the axis so as to overlie the first panel;

a hole through the substrate;

a hanger having a hook and a neck depending downwardly from the hook, the hook extending through the hole;

a pair of first flaps, each first flap being attached to the first panel of the substrate on an opposing side of the axis and being pivotal in the first direction, wherein the first tie is folded over the first flaps and secured to the substrate by the first flaps when they are securely attached to one another;

a pair of second flaps, each second flap being attached to the first panel of the substrate on an opposing side of the axis and being pivotal in the first direction, wherein the second tie is folded over the second flaps and secured to the substrate by the second flaps when they are securely attached to one another, the folded second tie overlying the secured first flaps and the folded first tie; and a securement attached to the flap to hold the pair of first and second panels to one another to preserve the fold.

2. The display unit of claim 1, further comprising a pair of third flaps, each flap being attached to the first panel of the substrate on an opposing side of the axis and being pivotal in the first direction, wherein the first tie is held in place by the third flaps when they are securely attached to one another, the first tie being folded over the secured third flaps.

3. The display unit of claim 1, wherein the neck extends the hook above the fold line to facilitate hanging the display unit.

4. The display unit of claim 1, further comprising an engagement surface having a first and second shoulders each having a top portion and a bottom portion and a respective slot separating the top and bottom portions, the slot of each shoulder extending toward the other shoulder to a depth.

5. The display unit of claim 4, wherein the slots extend toward one another.

6. The display unit of claim 5, wherein the internal cavity is disposed below the slot of the first shoulder and disposed inwardly of the depth of the first shoulder slot.

7. The display unit of claim 4, further comprising an internal cavity within the first shoulder, wherein the slot of the first shoulder communicates with the internal cavity.

8. The display unit of claim 7, wherein the internal cavity extends toward the second shoulder yet remains out of communication with the slot of the second shoulder.

9. The display unit of claim 4, wherein the slots of the first and second shoulders engage the substrate when the hanger is disposed within the hole.

10. The display unit of claim 1, wherein the hole is aligned with the axis.

* * * * *